US006129687A

United States Patent [19]

Powell et al.

[11] Patent Number: 6,129,687

[45] Date of Patent: Oct. 10, 2000

[54] ROLLABLE MASSAGING DEVICE

[76] Inventors: David Powell, 10800 Altheide Rd., Mount Vernon, Ind. 47620; Joseph H. Munning, 707 E. Walnut St., Washington, Ind. 47501

[21] Appl. No.: 08/916,111

[22] Filed: Aug. 21, 1997

[51] Int. Cl.[7] ..... A61H 15/00; B65D 6/16; B65D 21/08; B65D 6/28

[52] U.S. Cl. ..... 601/15; 601/19; 601/121; 220/4.07; 220/4.24; 220/4.27; 220/666

[58] Field of Search ..... 601/15, 19, 22, 601/27, 28, 118, 119, 120, 121, 122, 123, 125, 128, 131, 135, 137; 220/577, 4.07, 4.24, 4.27, 666

[56] References Cited

U.S. PATENT DOCUMENTS

| | | | |
|---|---|---|---|
| D. 119,035 | 2/1940 | Lindgren . | |
| 1,722,866 | 7/1929 | Snyder . | |
| 2,448,797 | 9/1948 | Gustlin | 128/24.3 |
| 2,546,095 | 3/1951 | Gustlin | 128/57 |
| 2,645,375 | 7/1953 | Topfer | 220/4 |
| 3,395,642 | 8/1968 | Foster et al. | 102/24 |
| 3,410,440 | 11/1968 | Thomas | 220/4 |
| 3,837,334 | 9/1974 | Johnson . | |
| 3,888,241 | 6/1975 | Fischer . | |
| 3,965,495 | 6/1976 | McNair . | |
| 4,873,966 | 10/1989 | Gitter . | |
| 4,884,560 | 12/1989 | Kuracina . | |
| 4,964,402 | 10/1990 | Grim et al. . | |
| 5,131,383 | 7/1992 | Juarez . | |
| 5,251,620 | 10/1993 | Boucher et al. . | |
| 5,545,197 | 8/1996 | Bowen . | |

*Primary Examiner*—Danton D. DeMille
*Attorney, Agent, or Firm*—Woodard, Emhardt, Naughton, Moriarty & McNett

[57] ABSTRACT

A rollable massaging device that simultaneously provides both hot and cold therapy is disclosed. The massaging device includes a first cylindrical container defining a first opening and a first longitudinal axis therethrough, and a second cylindrical container defining a second opening and a second longitudinal axis therethrough. The device includes a coupling that releasably and resealably engages said first and second opening. The first container is preferably filled with a hot liquid and the second container is preferably filled with a cold liquid, which are separated by a wall defined by the coupling. The outer surface of each container define any of a number of various surface profiles for massage therapy, such as a plurality of protusions, dimples, ridges, or ribs. In one alternative embodiment, the walls of the first and second containers may be adjustable in length to conform to the size of area to be massaged. In another embodiment, the first and second container also define first and second bottoms opposite the first and second openings to which the containers may be joined.

9 Claims, 6 Drawing Sheets

ROLLABLE MASSAGING DEVICE

FIELD OF THE INVENTION

This invention relates generally to devices which provide massage therapy to feet and other body parts, and more particularly relates to devices which provide hot and cold therapy to a portion of the body.

BACKGROUND

It is well known in the medical community that massage therapy, hot therapy, and cold therapy are all effective ways for relieving pain and treating an area of the body affected by injured and sore muscles, ligaments, and joints. Massage therapy devices typically exert pressure to provide relief to sore muscles, ligaments, and joints, and is an effective method to relieve tension throughout the entire body. Hot therapy and cold therapy are typically alternately applied directly to the affected area to provide localized relief and to promote healing of ailing muscles, ligaments, and joints.

Designers of massaging devices have attempted various designs to combine two of the three above described therapeutic techniques in a single device. For example, U.S. Pat. No. 5,131,383 to Juarez discloses a rollable foot massaging device that includes a long tubular body with a plurality of protuberances on its outer surface that create pressure points when rolled over the soles of the feet. The device is hollow so that a single liquid, either hot or cold, may be placed inside. Another example is U.S. Pat. No. 3,888,241 to Fischer. That massaging device includes a long tubular body made of ceramic material with a plurality of protuberances and dimples on its outer surface. The device is also hollow to allow hot liquid to be placed inside to radiate heat through the ceramic walls to the feet.

Another type of device is disclosed in U.S. Pat. No. 5,545,197 to Bowen. This device is a hot or cold therapy pack that includes a pair of compartments on either side of the therapy pack. The therapy pack is placed on the area to be treated after it has been activated by rupturing an inner portion located on either side of the pack. Alternating hot and cold therapy is available when both sides of the pack are activated.

All of the foregoing prior art suffers from several undesirable drawbacks. First, the massaging devices only allow the application of either hot therapy or cold therapy during the massage therapy, but not both. Second, the massaging devices are of fixed length and do not conform to the size of the area to be massaged. Finally, devices that provide for alternating hot and cold therapy do not provide for simultaneous massage therapy. Thus, none of the devices allow the simultaneous delivery of all three therapeutic remedies. There is, therefore, a need for a massaging device which simultaneously provides for the capability of treating the area being massaged with alternating hot therapy and cold therapy.

SUMMARY OF THE INVENTION

In order to address the foregoing shortcomings of the prior art, a rollable massaging device is disclosed which simultaneously provides for the application of alternating hot and cold therapy to an affected area of the body. In accordance with one aspect of the present invention, a rollable massaging device includes a first cylindrical container with a first opening and a second cylindrical container with a second opening. A coupling resealably engages the first and second openings in a manner that allows the massaging device to be rollable along its outer surface. Each container preferrably includes a substance disposed therein, each substance being of different temperature in order to simultaneously provide alternating hot therapy and cold therapy. The outer surface of the first or second container may consist of one of many profiles. The contemplated profiles include protuberances, dimples, ribs, or ridges, and the profile of the first container may or may not be similar to the profile of the second container.

According to another aspect of the present invention, a rollable massaging device is provided including a first cylindrical container with a first longitudinal axis therethrough and a second cylindrical container with a second longitudinal axis therethrough, said containers are joined so that the longitudinal axes are substantially coextensive. The length of the first container and second container is adjustable about its respective longitudinal axis by applying a force sufficient to expand or contract the accordian-like structure of the container. Each container preferrably includes an opening, through which a substance consisting of a first temperature is placed in the first container and a substance consisting of a second temperature is placed in the second container to simultaneously provide alternating hot therapy and cold therapy. The means for joining the containers includes a coupling that resealably engages said first and second openings, or a means that engages each end of the container opposite the opening of the container.

In accordance with a further aspect of the present invention, a rollable massaging device is provided including a first cylindrical container which defines a first opening resealably engaged by a first cap and a second cylindrical container defining a second opening resealably engaged by a second cap. Each container also includes a bottom opposite of the opening, and the two containers are joined so that their respective longitudinal axes are substantially coextensive. The means for joining the two containers includes a unitary wall that defines the bottom of each container. The outer surface of the first or second container may also consist of one of many profiles. The contemplated profiles include protuberances, dimples, ribs, or ridges, and the profile of the first container may or may not be similar to the profile of the second container.

It is one object of the present invention to provide a rollable massaging device capable of providing simultaneous hot and cold therapy while being used for massage therapy.

It is another object of the present invention to provide a rollable massaging device that is adjustable in length to conform to the size of the area to be massaged while being treated with hot therapy and cold therapy.

It is yet another object of the present invention to provide a rollable massaging device that allows simultaneous application of hot therapy and cold therapy by use of a single device in order to reduce the time and effort expended to receive a therapeutic massage with hot and cold therapy.

These and other objects of the present invention will become more apparent from the following description of the preferred embodiment.

DESCRIPTION OF THE PREFERRED EMBODIMENT

Figure 1:
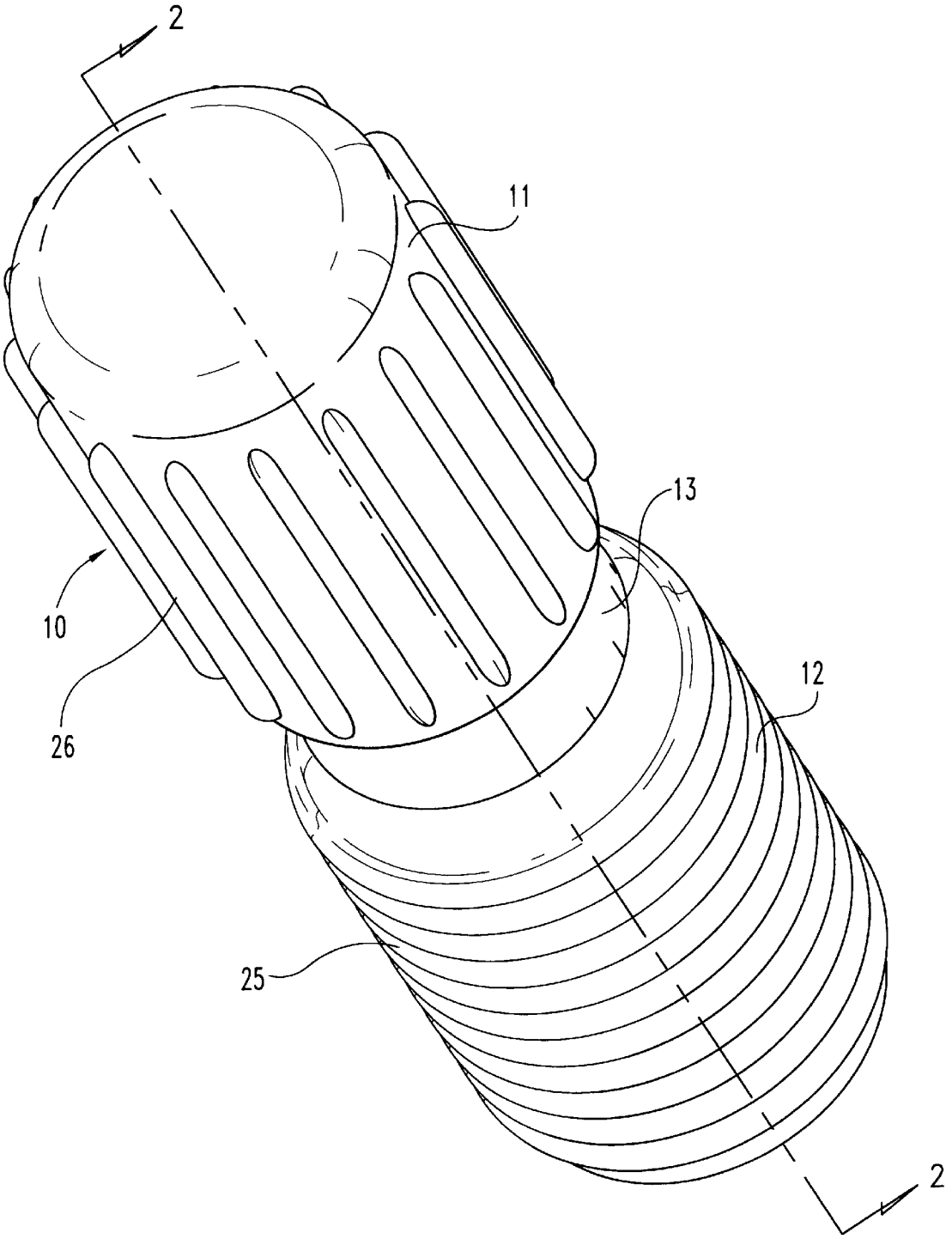
FIG. 1 is a perspective view of one embodiment of a rollable massaging device in accordance with the present invention.

For the purposes of promoting an understanding of the principles of the invention, reference will be made to the embodiment illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

In accordance with the present invention, a device for massaging and providing therapy to feet and other body parts is shown in FIGS. 1–6. The massaging device 10 massages the affected area by applying direct pressure to the area over which it is rolled. Additional therapy is provided by filling a first container 11 with either hot or cold liquid and a second container 12 with cold or hot liquid. Thus, in addition to providing hot or cold therapy, massaging device 10 allows simultaneous hot and cold therapy to be provided to the affected area while it is being massaged.

Figure 2:
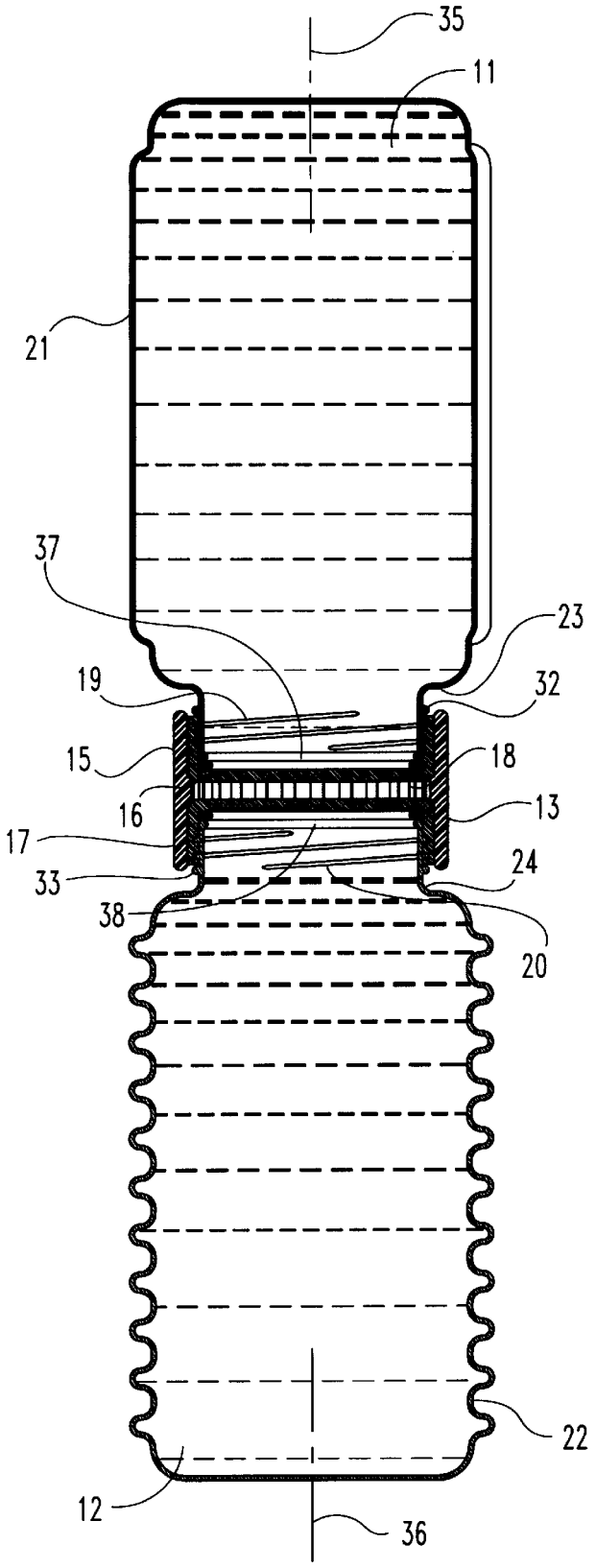
FIG. 2 is a section view of the rollable massaging device of FIG. 1 taken along section line 2—2 thereof.

According to a preferred embodiment of a massaging device 10, as illustrated in FIGS. 1 and 2, a first container 11 and a second container 12 are provided to be engaged to a coupling 13 that physically separates the contents of each container during use of the massaging device 10. Coupling 13 is releasably and resealably engageable to first container 11 and second container 12 as shown in FIG. 2. Coupling 13 further includes a wall 18 to physically separate the contents of first container 11 and second container 12 when resealably engaged as shown in FIG. 2.

Figure 3:
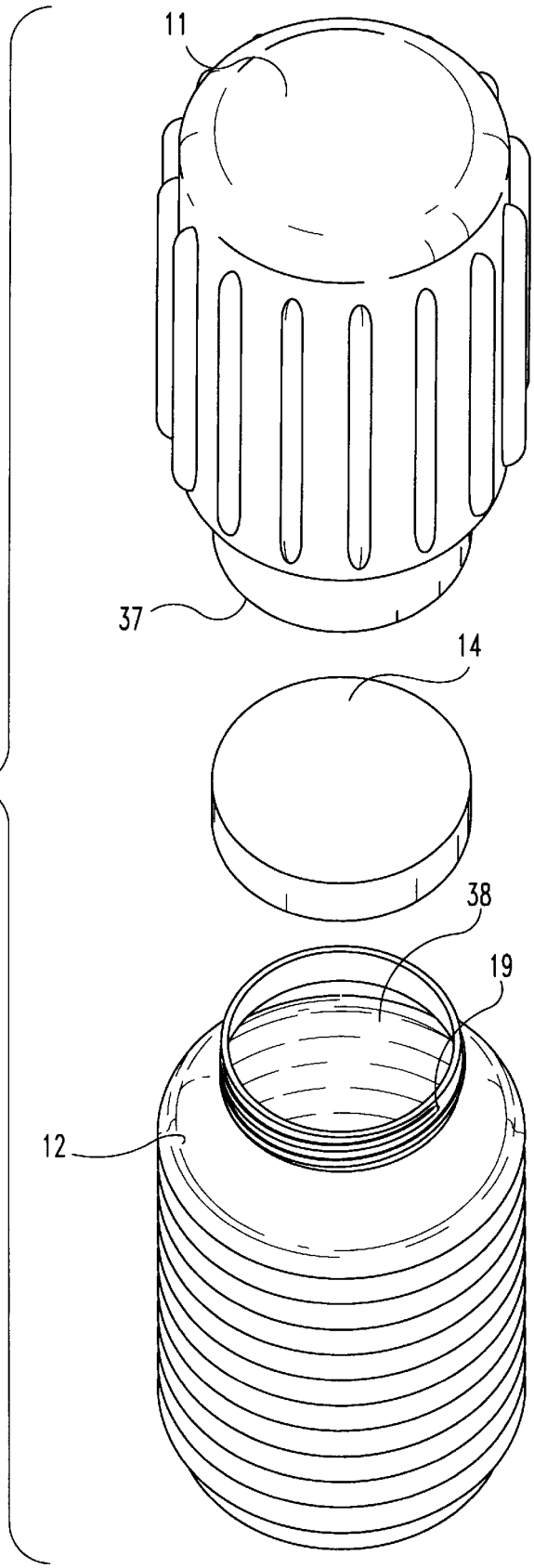
FIG. 3 is a perspective view of a rollable massaging device with the first and second containers decoupled and a separate cap in position to be placed over the opening of the second container.

Referring to FIG. 2, the first container 11 is cylindrical and includes a first neck 23 and the second container 12 is cylindrical and includes a second neck 24. The first container 11 defines first opening 37 and second container 12 defines second opening 38. To provide simultaneous alternating hot therapy and cold therapy, a liquid of a first temperature, such as a hot liquid, is placed in first container 11 through first opening 37. A liquid of a second temperature, such as a cold liquid, is placed in second container 12 through second opening 38. Alternatively, liquid of any temperature may be placed in first container 11 or second container 12, and the liquid in either container may thereafter be heated or cooled to a desired temperature. A cap 14 may be placed over first opening 37 or second opening 38, as shown in FIG. 3, in such a subsequent heating or cooling process, or when storing the liquid within either container. Other substances may alternatively be placed in the containers, such as ice, gels, or powders, so long as they are able to be placed within either container and cause the outer surface of the corrsponding container to reach the desired temperature.

The first neck 23 and second neck 24 preferrably include first container threads 19 and second container threads 20. As shown in FIG. 3, cap 14 may threadedly engage first container threads 19 or second container threads 20 when the containers are not engaged to coupling 13. When the massaging device 10 is to be used, cap 14 is removed and first container 11 and second container 12 are releasably and resealably engaged to coupling 13.

Coupling 13 includes first coupling threads 15 and second coupling threads 17 to engage first container threads 19 and second container threads 20. Coupling 13 also includes a wall 18 to physically separate the contents of the containers. Seal 16 and seal 16' are located in coupling 13 such that first container 11 contacts seal 16 and second container 12 contacts seal 16' when engaged to coupling 13. Seal 16 and seal 16' prevent leakage of the contents of first container 11 and second container 12 by deforming, as is known in the art, to ensure all gaps between first container 11, second container 12, and coupling 13 are closed. Preferrably, seals 16 and 16' are made of a flexible, elastometric material, such as rubber, but any other material which adequately performs the above described function may be used.

First container 11 defines a first longitudinal axis 35 and second container 12 defines a second longitudinal axis 36. First longitudinal axes 35 extends through first opening 37 such that first container 11 extends radially about it. Second longitudinal axes 36 extends through second opening 38 such that second container 12 extends radially about it. First container 11 and second container 12 resealably engage coupling 13 in a manner that allows first longitudinal axis 35 and second longitudinal axis 36 to be substantially coextensive. This allows the massaging device 10 to easily roll about longitudinal axes 35 and 36. In a preferred embodiment, a first neck 23 and a second neck 24 allow first container surface 21 and second container surface 22 to rollably engage a contact surface, such as a foot or other body part, or a support surface such as a floor, and prevent coupling 13 from creating a pivot point that inhibits control over rolling the device.

Preferrably, coupling 13 and cap 14 are "childproof" so they will not accidentally disengage from either container when in place.Coupling 13 includes first inner threaded member 15 and second inner threaded member 17. First threaded member 15 and second inner threaded member 17 retain first container 11 and second container 12 to coupling 13 and are rotatable within coupling 13. Each inner threaded member engages wall 18 when a force is applied to the container engaged to that member in the direction of coupling 13. Coupling 13 remains sealably engaged to first container threads 19 and second container threads 20 whenever either container is rotated while engaged to the coupling. Either container may be disengaged from coupling 13 by forcing the container towards coupling 13 with sufficient force to cause the respective inner threaded member to engage wall 18, and then subsequently threadedly disengaging the container as is known in the art.

Other types of mechanisms for securing cap 14 and coupling 13 to first container 11 or second container 12 are also contemplated. In one emdodiment, first container threads 19 and second container threads 20 are replaced by a lip that allows cap 14 or coupling 13 to snap onto first container 11 and second container 12. In another embodiment, cap 14 and coupling 13 include a structure that resealably plugs first opening 37 and second opening 38 when placed within said openings. Preferrably, coupling 13 and cap 14 are "childproof" so they will not accidentally disengage from either container when in place.

Figure 4:
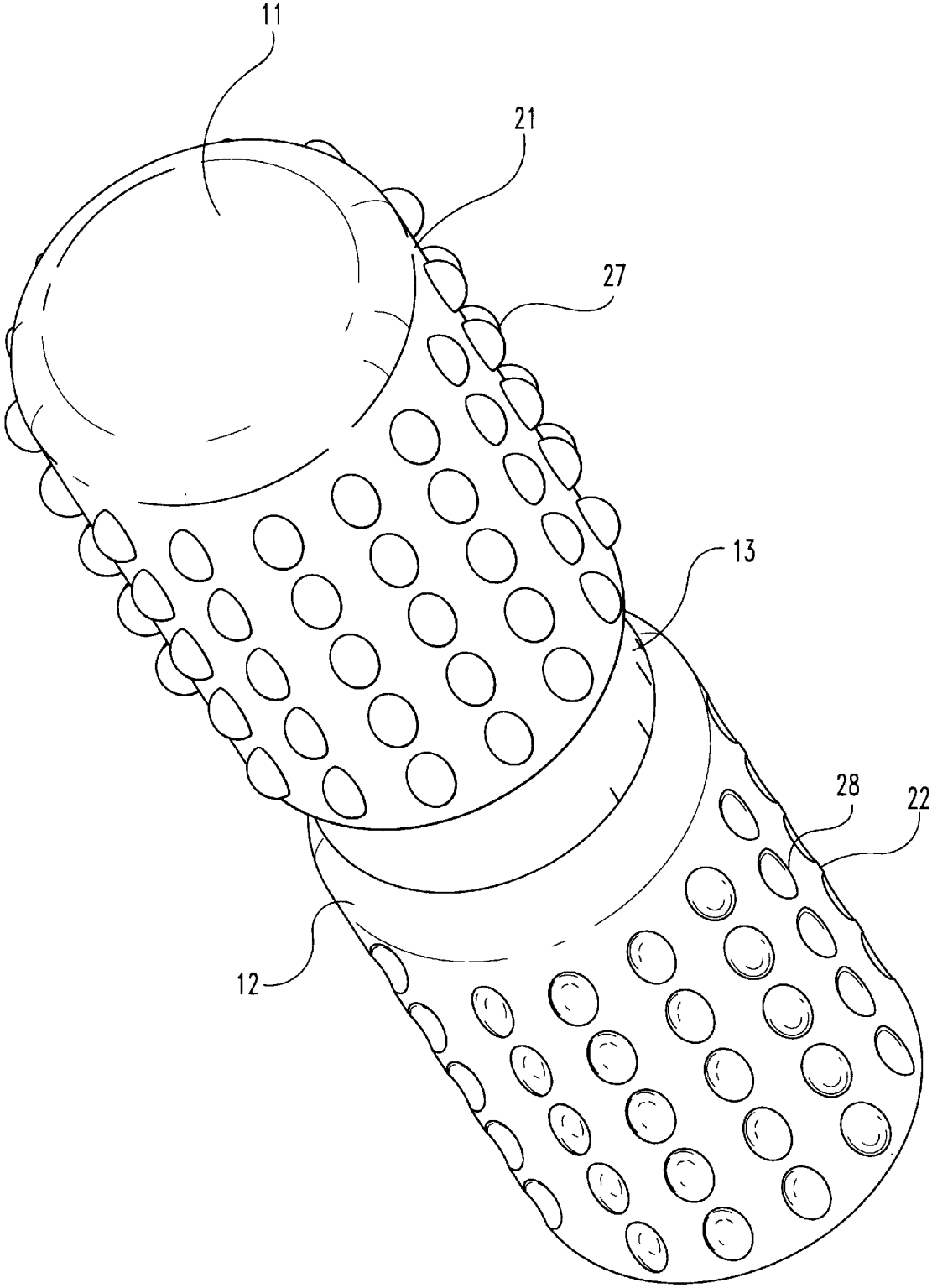
FIG. 4 is a perspective view of an alternate embodiment of a rollable massaging device illustrating alternate profiles on the outer surfaces of the first and second containers.

A variety of structures and materials may be used for first container 11 and second container 12, so long as adequate heat transfer is allowed between the hot or cold substance disposed within the container and the area to be massaged, and so long as the structure or material is capable of withstanding the hot and cold temperature extremes. In a preferred embodiment, a polymer such as plastic is used. This allows first container surface 21 and second container surface 22 to be molded to include many types of configurations. For instance, FIG. 1 shows first container 11 with a first container surface 21 that defines a plurality of ribs 26 that extend parallel to longitudinal axis 35. FIG. 1 also shows second container 12 with a second container surface 22 that defines a plurality of ridges 25 that extend perpendicular to longitudinal axis 35. Referring to FIG. 4, another embodiment of the present invention shows first container surface 21 with a plurality of protuberances 27 defined thereon. Second container surface 22 is shown with a plurality of dimples 28 defined thereon. Other materials for first and second container 12 are acceptable so long as they allow the formation of various types of profiled surfaces and provide for adequate thermal transfer therethrough.

Each of the embodied container surface configurations may be used alone or in combination with other configurations. The first container 11 and second container 12 may consist of the same surface configuration or use different surface configurations while therapy is being applied.

Figure 5:
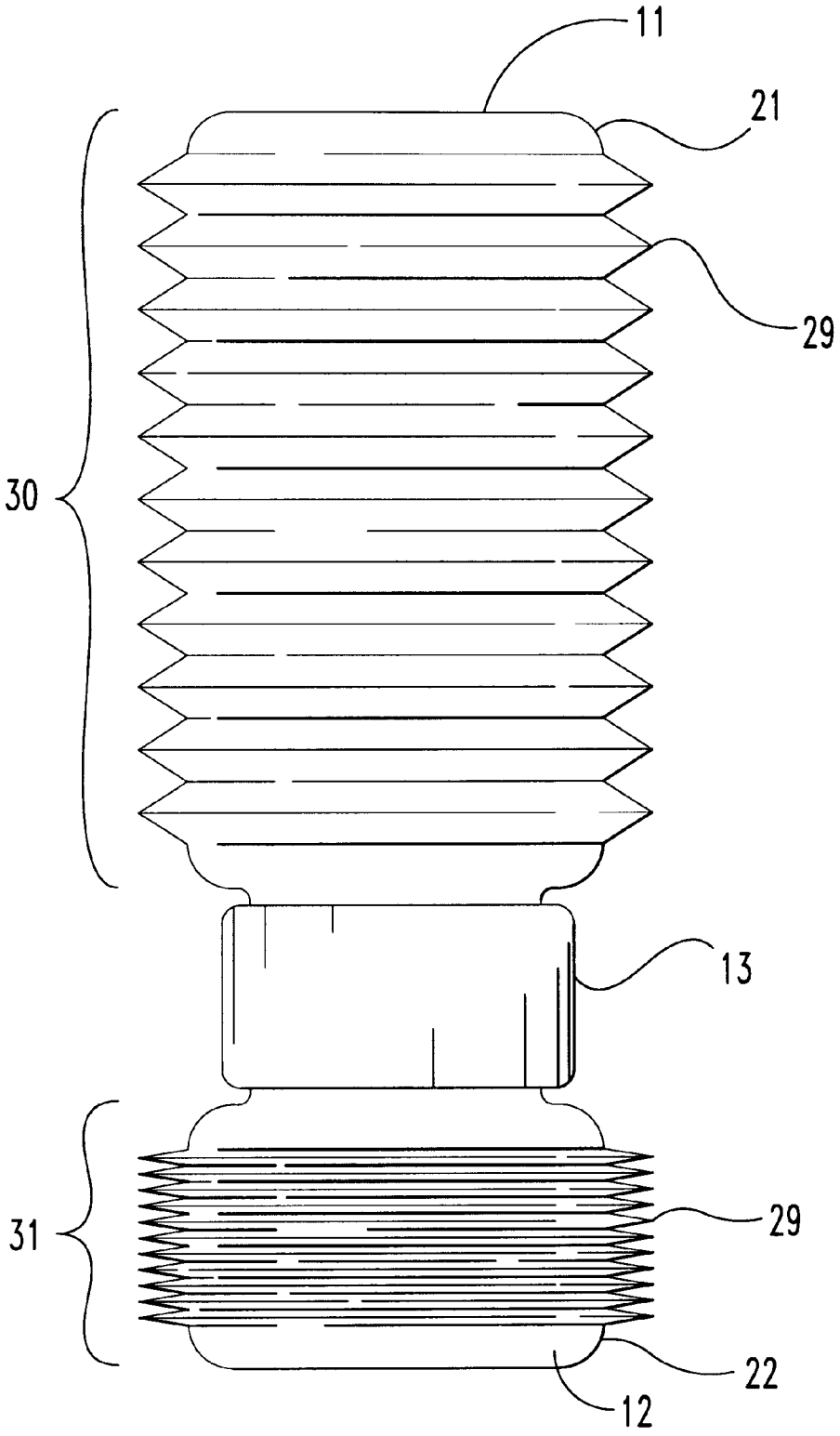
FIG. 5 is a perspective view of another embodiment of a rollable massaging device in which the length of the containers is adjustable about the longitudinal axes of the containers.

Referring now to FIG. 5, another embodiment of the present invention is illustrated. First container 11 and second container 12 are shown to be adjustable in length about first longitudinal axis 35 and second longitudinal axis 36. First container surface 21 and second container surface 22 define an accordian-like structure 29 that allows both containers to be fully adjustable from a first position 30 to a second position 31, and anywhere in between, by compressing or expanding the wall of the container along its respective longitudinal axis. The containers may be adjusted by applying a moderate amount of force to one end of the container while the opposite end is held in place. Having containers adjustable in length allows the massaging device to conform to the size of the body area to be massaged and treated, and also concentrates the pressure and temperature therapy to the area to be massaged.

Figure 6:
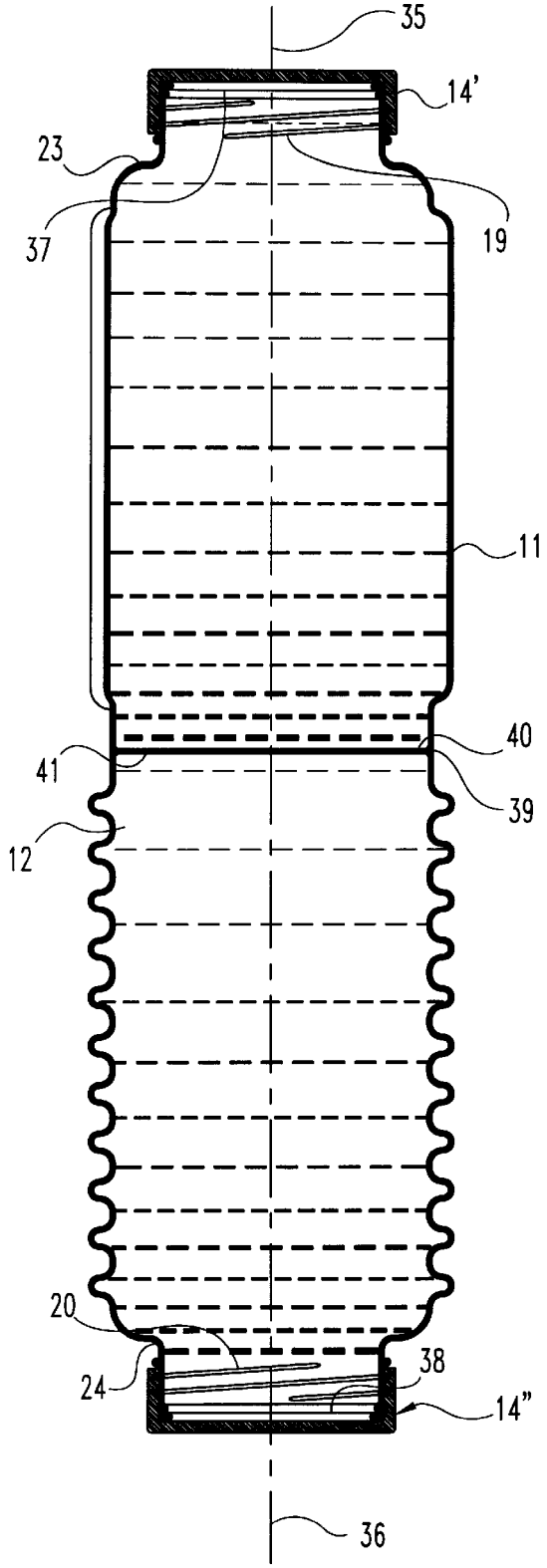
FIG. 6 is a cross-sectional view of yet another embodiment of a rollable massaging device in accordance with the present invention.

Referring now to FIG. 6, an alternate embodiment of the present invention is illustrated. The first container 11 is releasably and resealably engaged to first cap 14', and second container 12 is releasably and resealably engaged to second cap 14". The first container 11 defines a first bottom 40 opposite first opening 37 and second container 12 defines a second bottom 41 opposite second opening 38. In one embodiment, the first bottom 40 and second bottom 41 may be joined by any known means, such as an adhesive or the like, to form the massaging device from two separate containers. In yet another embodiment, the two containers may be formed as a single unit, such as by molding as is known in the art, wherein first bottom 40 and second bottom 41 are formed as a single unitary wall 39. These container configurations may be used with any of the other container embodiments shown in FIGS. 1–5.

Operationally, massaging device 10 is most effective when first container surface 21 and second container surface 22 rollably engage the area to be massaged and treated. One use of massaging device 10 is to provide therapy to the feet. When used in this manner, massaging device 10 is set on the floor or other flat surface, and the device is rollably manipulated by the users feet about first longitudinal axis 35 and second longitudinal axis 36. Preferrably, one foot is placed on each container to allow one foot to receive heat therapy and the other foot to receive cold therapy. The massaging device 10 may then be rotated so the foot that first received heat therapy is now receiving cold therapy, and the foot that first received cold therapy is now receiving heat therapy. This alternating pattern of hot therapy and cold therapy is continued until the desired results are achieved.

Another method of using the device is to set the device on the area of the body to be massaged and to rollably manipulate it by hand about the longitudinal axes 35 and 36. In any event, the massaging device is most effective when it rollably engages the affected area so that the surface profiles of the first container 11 and second container 12 apply pressure to the afflicted muscles, ligaments, and the like. It is also important that the device remain in contact with the body so that simultaneous alternating hot therapy and cold therapy is continuously applied while the affected area is being massaged.

While the invention has been illustrated and described in detail in the drawings and foregoing decsription, the same is to be considered as illustrative and not restrictive in character, it being understood that only the preferred embodiment has been shown and described and that all changes and modifications that come within the spirit of the invention are desired to be protected.

What is claimed is:

1. A rollable massaging device comprising:

a first cylindrical container defining a first longitudinal axis therethrough and a length;

a second cylindrical container defining a second longitudinal axis therethrough and a length;

means for joining said first cylindrical container to said second cylindrical container with said first longitudinal axis being substantially coextensive with said second longitudinal axis; and wherein at least one of said first and second cylindrical containers defines an accordion-like structure along at least a portion of said longitudinal axis of said container, said accordion-like structure allowing at least one of said first and second containers to be adjustable in length along a corresponding one of said first and second longitudinal axes.

2. The device according to claim 1, wherein said first cylindrical container includes a first opening at one end thereof and said second cylindrical container includes a second opening at one end thereof.

3. The device according to claim 2, wherein said means for joining includes a coupling configured to resealably engage said first opening and to resealably engage said second opening.

4. The device according to claim 2, further including a first cap for resealably engaging said first opening and a second cap for resealably engaging said second opening.

5. The device according to claim 4, wherein at least one of said caps threadedly engages said corresponding container.

6. The device according to claim 1, wherein said first cylindrical container defines a first outer surface and said second cylindrical container defines a second outer surface, wherein at least one of said first and second outer surfaces defines a number of protuberances thereon.

7. The device according to claim 6, wherein the outer surface of at least one of said first and second cylindrical containers defines a number of dimples.

8. The device according to claim 6, wherein the outer surface of at least one of said first and second cylindrical containers defines a number of ribs extending parallel to a corresponding one of said first and second longitudinal axes.

9. The device according to claim 6, wherein the outer surface of at least one of said first and second cylindrical containers defines a number of ridges extending perpendicular to a corresponding one of said first and second longitudinal axes.

* * * * *